US005881976A

United States Patent [19]

Gutowski

[11] Patent Number: 5,881,976

[45] Date of Patent: Mar. 16, 1999

[54] MOBILE PALM HEEL, WRIST AND FOREARM SUPPORT FOR USE WITH KEYBOARDS

[76] Inventor: Walter M. Gutowski, 7610 E. Vista Dr., Scottsdale, Ariz. 85250

[21] Appl. No.: 969,840

[22] Filed: Nov. 13, 1997

Related U.S. Application Data

[63] Continuation-in-part of Ser. No. 673,573, Jul. 1, 1996, abandoned.

[51] Int. Cl.[6] ..... B43L 15/00

[52] U.S. Cl. ..... 248/118.5; 248/118.1; 248/276.1; 400/715

[58] Field of Search ..... 248/118, 118.1, 248/118.5, 918, 298.1, 276.1; 400/715

[56] References Cited

U.S. PATENT DOCUMENTS

| | | | |
|---|---|---|---|
| 607,675 | 7/1898 | Barr | 248/118.1 |
| 4,576,351 | 3/1986 | Brink | 248/118 |
| 4,863,140 | 9/1989 | Schriner | 248/639 |
| 5,050,826 | 9/1991 | Johnston | 248/118.3 |
| 5,104,073 | 4/1992 | Vanbeek | 248/118.3 |
| 5,108,057 | 4/1992 | Dandy, III | 248/118 |
| 5,135,190 | 8/1992 | Wilson | 248/118.1 |
| 5,158,256 | 10/1992 | Gross | 248/118.3 |
| 5,161,760 | 11/1992 | Terbrack | 248/118 |
| 5,201,485 | 4/1993 | Moss et al. | 248/118 |
| 5,219,136 | 6/1993 | Hassel | 248/118 |
| 5,348,408 | 9/1994 | Gelardi | 400/715 |
| 5,375,800 | 12/1994 | Wilcox | 248/118.1 |
| 5,383,632 | 1/1995 | Shirlin et al. | 248/118.5 |
| 5,386,957 | 2/1995 | Miller | 248/118.5 |
| 5,398,896 | 3/1995 | Terbrack | 248/118.5 |
| 5,402,972 | 4/1995 | Schmidt | 248/118 |
| 5,456,099 | 10/1995 | Sereboff | 248/118.1 |

*Primary Examiner*—William Strylewski
*Attorney, Agent, or Firm*—John D. Lister

[57] ABSTRACT

An apparatus includes one or a pair of support platforms for supporting the palm heels, wrists and forearms of an operator relative to a keyboard. The support platforms lie in a plane extending parallel and adjacent to the upper surfaces of the keyboard keys. Where two support platforms are used, the support platforms are mounted on carriages, independently of each other, so that the support platforms can be moved in the plane: a) in a first direction, perpendicular to the keyboard rows between forward positions where forward edges of the support platforms preferably overlap at least a portion of the first row of keyboard keys and b) rearward positions where the forward edges of the support platforms are positioned between the operator and the first row of keyboard keys, and in a second direction, parallel to the keyboard rows, whereby all keyboard keys can be operated by flexion and extension of the operator's fingers with substantially no flexion or extension of the operator's wrists which along with the operator's palm heels and forearms remain supported by and at rest on the upper surfaces of the support platforms during operation of the keyboard.

36 Claims, 11 Drawing Sheets

360
362
364
366
368
370
372
380
382
384
19
20
22

MOBILE PALM HEEL, WRIST AND FOREARM SUPPORT FOR USE WITH KEYBOARDS

This application is a continuation-in-part of my application Ser. No. 08/673,573, filed Jul. 1, 1996, now abandoned.

BACKGROUND OF THE INVENTION

The present invention relates to a mobile hand, wrist and forearm support for use with computer, typewriter and similar keyboards and, in particular, to a mobile hand, wrist and forearm support for preventing carpal tunnel syndrome, tendinitis, neck and shoulder strain, and other repetitive strain and/or sprain injuries when using keyboards, and for enabling operators with motor control disabilities to use keyboards.

Known supports for keyboard operators do not provide the necessary support and mobility for the operator's hands, wrists and forearms to enable the operator to easily and effortlessly reach all of the keys of the keyboard with his/her fingers without causing undue flexion extension movement of the wrist.

A number of supports for keyboard operators, such as those disclosed in U.S. Pat. Nos. 5,104,073, 5,219,136, 5,348,408, 5,356,099, 5,375,800, and 5,402,972, provide supports which are positioned between the keyboard and the operator and, once positioned, essentially remain fixed while the operator slides his/her hand, wrist or forearm over the fixed support. Typically, these fixed supports are spaced outwardly from the front of the keyboard and, as the operator reaches for certain keys, especially for keys in one of the back rows such as the function keys, the heel of the palm and frequently the wrist of the operator are no longer directly supported by the fixed support.

A support for keyboard operators, such as shown in U.S. Pat. No. 5,050,826, is also positioned between the keyboard and the operator and, while the support pads 20 move laterally, the heel of the palm and the wrist of the operator are no longer directly supported when the operator reaches for keys in back rows of keys.

A support for keyboard operators, such as shown in U.S. Pat. No. 5,108,057, is positioned over the keyboard, as shown in FIG. 5, with one of the transverse support bars for the hand rests over the keyboard. The positioning of the transverse support bars over the keyboard raises the hands of the operator relative to the keys of the keyboard and the use of extenders, such as extender 44, to help the operator reach the forward row(s) of keys, is suggested. However, even as shown with an extender, the operator could not conveniently reach key 46 or the extender 44 since the operator's thumb can not pass through the transverse support bar 18.

Another form of support for keyboard operators is shown in U.S. Pat. No. 5,158,256. This support includes a pair 4of wrist pads 54 and 56 which are positioned between the operator and the keyboard, can be move laterally, be adjusted vertically and pivot about screw 68 as shown in FIG. 4. However, as the operator reaches for certain keys, especially for keys in one of the back rows such as the function keys, the heel of the palm and, probably, the wrist of the operator would no longer be directly supported by the fixed support.

U.S. Pat. No. 5,161,760, shows another form of operator support which includes a pair of pivotally mounted extensible bars 24 and 26 with support pads 68 and upwardly biased handles 58 rotatably mounted on the ends of the extensible bars.

U.S. Pat. No. 5,383,632, shows a support for wrists and forearms that includes two arm rests that can be positioned in front of a platform which supports a keyboard.

U.S. Pat. No. 5,386,957, shows a hand support wherein the keyboard is placed within a frame and the hand support 14 is slidably mounted on transverse bars 18 which in turn are slidably mounted on bars 24 so that the entire hand support 14 with its mounting blocks or gliders 22 can pass, in an elevated horizontal plane, over the keyboard so that one finger digit of the operator can contact the keys on the keyboard.

SUMMARY OF THE INVENTION

The support apparatus of the present invention for supporting the palm heels, wrists and forearms of keyboard operators solves the problems of the prior art by providing mobile support surfaces that permit the keyboard operator to reach all of the keys on a keyboard by flexion and extension of the operator's fingers and no or substantially no flexion or extension of the operator's wrists which along with the operator's palm heels and forearms are supported by and remain at rest on the mobile support surfaces.

In one embodiment of the apparatus of the present invention, the apparatus includes a pair of support platforms for supporting the palm heels, wrists and forearms of an operator relative to a keyboard. The support platforms lie in a plane extending parallel and adjacent to the upper surfaces to the keyboard keys and have thin forward edge portions which permit the support platforms to extend out over the keys in this plane with the support surfaces of the platforms preferably spaced only about 3/16 to about ¼ an inch above the upper surfaces of the keys. Where two support platforms are used, the support platforms are mounted, for movement independent of each other, on carriages of a carriage assembly so that the support platforms can be moved in the aforementioned plane: a) in a first direction, perpendicular to the keyboard rows between forward most positions where forward edges of the support platforms preferably overlap at least a portion of the first row of keyboard keys and rearward most positions where the forward edges of the support platforms are preferably positioned between the operator and the first row of keyboard keys, at least one half of an inch from the first row of keyboard keys, and b) in a second direction, parallel to the rows of keyboard keys (whether the rows of keyboard keys are straight or nonlinear (not arranged in a straight line, such as but not limited to, the MICROSOFT natural keyboard), and preferably for the entire lengths of the rows of keyboard keys. Thus, with the present invention, all keyboard keys can be operated by flexion and extension of the operator's fingers with substantially no flexion or extension of the operator's wrists which along with the operator's palm heels and forearms remain supported by and at rest in a common or substantially common plane on the upper surfaces of the support platforms during operation of the keyboard. For certain applications, such as applications where a mouse may be used by the operator, the movement in the second direction of the platform(s) may extend beyond the keyboard on one or both sides of the keyboard to facilitate the movement of the mouse by the operator while his/her palm heel(s), wrist(s) and forearm(s) are supported by the support platform(s).

Preferably, the carriage assembly is positioned between the keyboard and the operator so that the level of the support platforms can be maintained in a plane immediately above the upper surfaces of the keyboard keys. For ease of movement, it is preferred to mount the support platforms on wheeled carriages in the carriage assembly. However, the carriages can be slidably mounted on support rods or other means that permit the desired movement of the support platforms across the keyboard in a plane immediately above and parallel or substantially parallel to the upper surfaces of the keyboard keys so that the upper surfaces of the support platforms are preferably spaced only about 3/16 to about 1/4 of an inch above a plane containing the upper surfaces of the keyboard keys.

In certain embodiments of the invention, the support platform(s) may include forward portion(s) adjacent their forward edges that permit the palm heel and hand of the operator to pivot relative to the wrist while resting on the upper surface of the support platform. Support platforms which permit the palm heel and hand of the operator to easily pivot relative to the wrist include but are not limited to support platforms with rotatably or pivotally mounted disks or plate sections at forward portions,. The support platforms may also include forward portions contoured to be received in or under the palm and under the palm heel and wrist of the operator.

In another embodiment of the present invention, a single support platform is used rather than the two support platforms discussed above. By using a single support platform, that is wide enough to support both palm heels, wrists and forearms of the operator, one arm of the operator can be used to move both hands across the keys of the keyboard. Thus, an operator with a partial disability can use one arm to move both hands over the keyboard so that the operator can still operate the keyboard keys by flexing and extending the fingers of both hands with little or no flexion or extension movements of either wrist.

Certain embodiments of the support apparatus may also include spring loaded assemblies or other means that permit the support platform(s) to be retained in a stationary position by exerting a selected downward force on the support platforms and permit the support platform(s) to be moved by exerting less than the selected downward force on the support platform(s).

DESCRIPTION OF THE PREFERRED EMBODIMENTS

FIGS. 1–4 show a preferred embodiment 20 of the palm heel, wrist and forearm support apparatus of the present invention positioned in front of a typical computer keyboard 22. While a computer keyboard is shown, the palm heel, wrist and forearm support apparatus of the present invention can be used with other keyboards, such as but not limited to, typewriter keyboards, calculator keyboards and similar keyboards.

Figure 12:
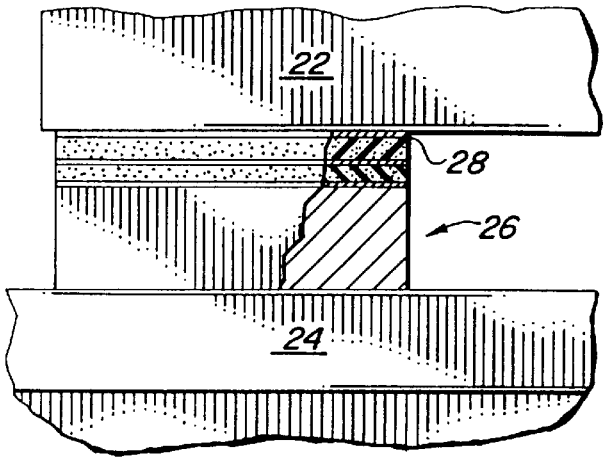
FIG. 12 is an enlarged view of the keyboard support shown in FIG. 2.
Figure 13:
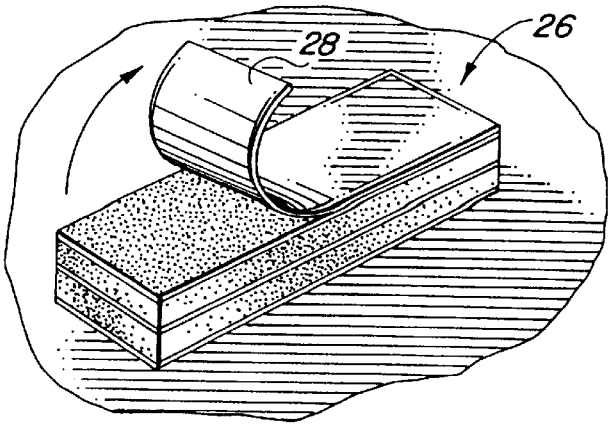
FIG. 13 is a view of the keyboard support of FIG. 11 with a layer partially removed.

The palm heel, wrist and forearm support apparatus 20 is, preferably, mounted on and secured to a base plate 24 by adhesives, screws or other fasteners, not shown, or is integral with the base plate 24 which also carries or supports the keyboard 22. The base plate 24 can be made of a polymeric sheet material, wood, metal or the like, but preferably is made of a polymeric sheet material. The base plate 24 is preferably provided with keyboard support pads 26, such as the pad 26 shown in FIGS. 12 and 13, upon which the keyboard 22 is positioned relative to the palm heel, wrist and forearm support apparatus 20 or other means for regulating the height and/or angle of the plane containing the upper surfaces 30 of the keyboard keys 32 relative to the palm heel, wrist and forearm support apparatus of the present invention. As shown in FIGS. 12 and 13, surface layers 28 of the base plate pads 26 can be removed or peeled away from or added to the pads 26 to regulate the height of the plane containing the upper surfaces 30 of the keyboard keys 32 relative to the palm heel, wrist and forearm support apparatus of the present invention. An example of one type of surface layer 28 that can be used on the support pads 26 is a sheet, e.g. rubber or plastic, with an anti-skid upper surface and a lower surface coated with a pressure sensitive adhesive. When not in use the lower surfaces of the surface layer sheets could be covered with a release sheet so that the surface layers 28 can be reused if necessary.

As shown in FIGS. 1–4, the palm heel, wrist and forearm support apparatus 20 includes a pair of support platforms 34 and 36; a pair of primary carriages 38 and 40 on which the support platforms 34 and 36 are mounted; a pair of secondary carriages 42 and 44 on which the primary carriages 38 and 40 are mounted; and a base track assembly 46 on which the secondary carriages 42 and 44 are mounted. The above components of the palm heel, wrist and forearm support assembly 20 can be made of polymeric materials (e.g. molded plastics), metals (e.g. aluminum, stainless steel) or similar materials.

The left and right support platforms 34 and 36 of the palm heel, wrist and forearm support apparatus 20 can be moved in both the "X" direction (perpendicular to the keyboard 22 and the rows 48 of keyboard keys) and the "Y" direction (parallel to the keyboard 22 and the rows 48 of keyboard keys). Preferably, the support platforms 34 and 36 are made of a thin sheet material about ⅛ of an inch thick.

The support platforms 34 and 36 are sized to comfortably support the palm heels, wrists and forearms of the keyboard operator and typically have a length in the "X" direction of about seven and one half inches, preferably extending about one half of the way or more from the wrist to the elbow of the keyboard operator, and a width in the "Y" direction of about four and one half inches. The forward edges 50 and 52 of the support platforms 34 and 36 can be somewhat rounded, but preferably the forward edges 50 and 52 of the support platforms 34 and 36 are substantially straight and extend generally in the "Y" direction or parallel to the key rows 48. If desired, the inside ends of the forward edges 50 and 52 can be cut away or configured, for example, as shown by dashed lines 50*a* and 52*a* in FIG. 1, to facilitate the movement of the operators thumbs.

The outside lateral edges 54 and 56 and the inside lateral edges 58 and 60 of the support platforms 34 and 36 are preferably inclined inwardly toward the forward edges 50 and 52 of the support platforms, e.g. at an angle of about 15° to the "X" direction. Since the forearms of the keyboard operator are also going to be inclined inwardly toward the keyboard 22, the angular orientation of the lateral edges 54, 56, 58 and 60 reduces the surface area of the support platforms 34 and 36 and saves on material costs without lessening the support provided to the palm heels, wrists and forearms of the keyboard operator. The configurations of the trailing edges 62 and 64 of the support platforms 34 and 36 may vary. However, all of the corners of the support platforms 34 and 36 are preferably rounded to prevent the support platforms from snagging onto the keyboard operator's clothing.

The support platforms 34 and 36 are mounted on primary carriages 38 and 40 of a carriage assembly. As shown in FIGS. 1–4, the primary carriages 38 and 40 each include a pair of frame members or bars 66, 68 and 70, 72 integral with or secured to the undersides of the support platforms 34 and 36 and extending in the "X" direction. Each frame member has a pair of wheels or rollers 74, rotatably mounted thereon. The wheels or rollers 74 are received in tracks 76 of the secondary carriages 42 and 44 and preferably have annular flanges 75 to help keep the wheels properly aligned in the tracks 76.

Figure 1:
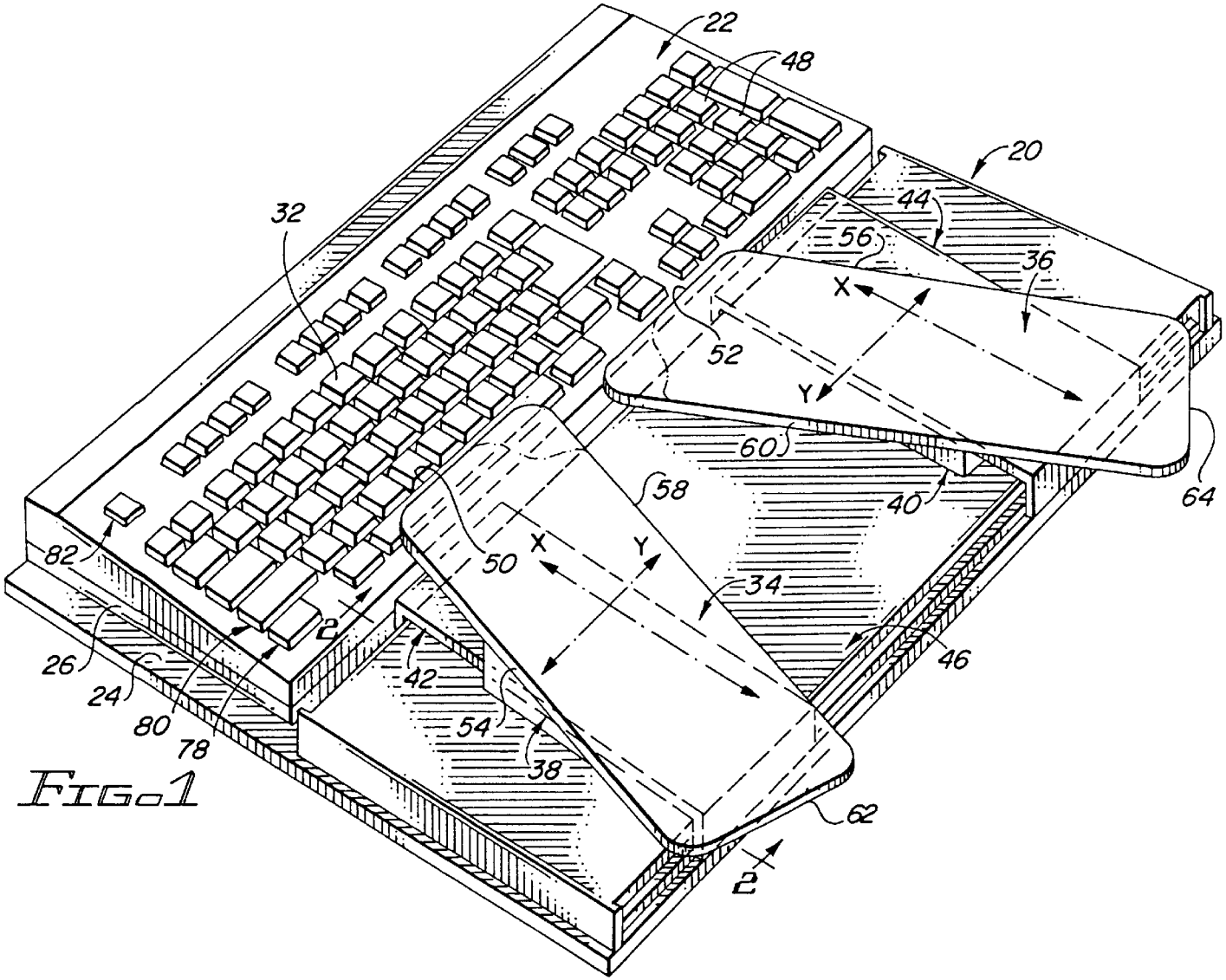
FIG. 1 is a perspective view of a preferred embodiment of the mobile hand, wrist and forearm support of the present invention positioned before a typical computer keyboard.
Figure 2:
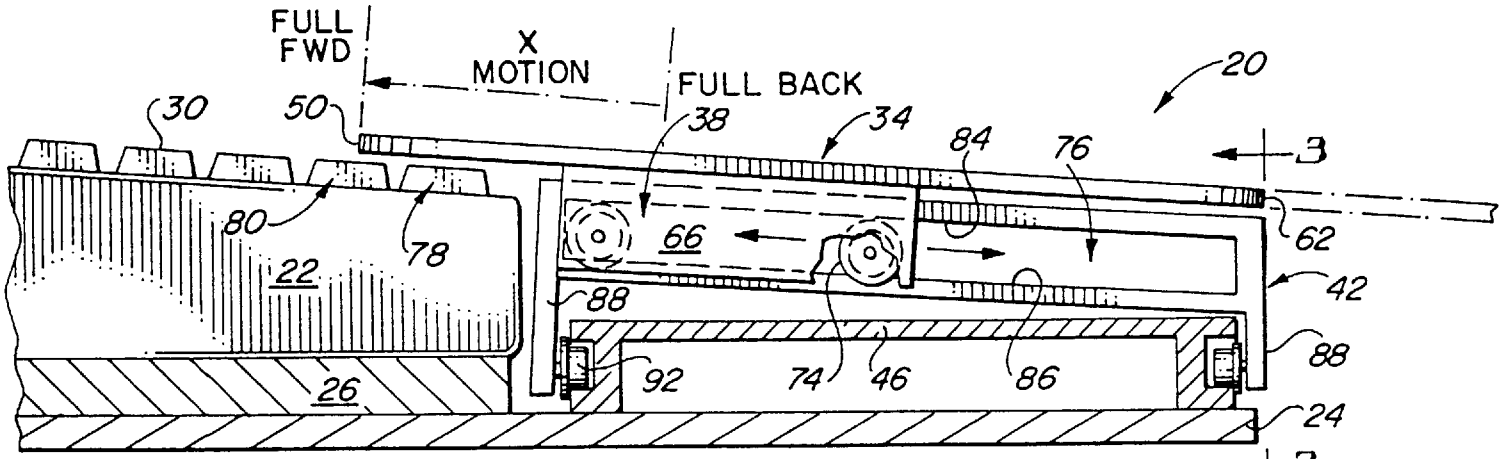
FIG. 2 is a section through the mobile hand, wrist and forearm support of FIG. 1 taken substantially along lines 2—2 of FIG. 1.
Figure 3:
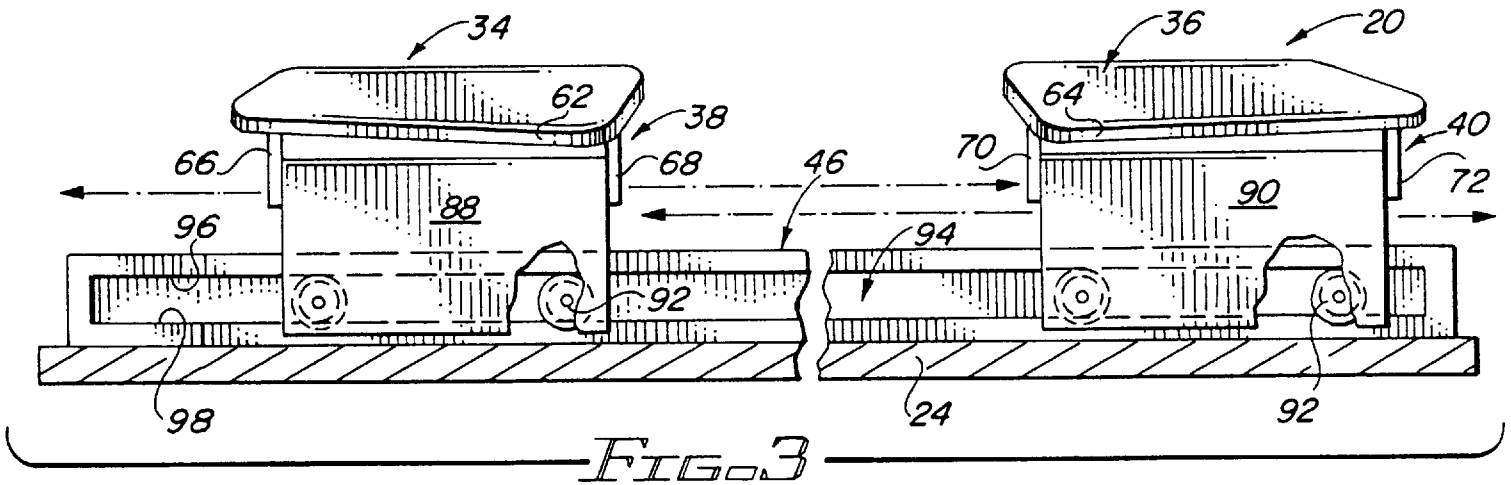
FIG. 3 is a view of the mobile hand, wrist and forearm support of FIG. 1 taken substantially along lines 3—3 of FIG. 2.

The tracks 76 in the secondary carriages 42 and 44 each extend in the "X" direction and are inclined to the horizontal at an angle substantially equal to or, preferably, equal to the angle to the horizontal of the plane containing the upper surfaces 30 of the keyboard keys 32. The upper surfaces of the keyboard keys of computers, typewriters and similar machines lie in planes ranging from a horizontal plane to planes oriented at about 30° to the horizontal but, typically lie in a plane oriented between about 3° and about 7° to the horizontal. With this construction, the support platforms 34 and 36 can be extended over the keyboard keys 32, as shown in FIG. 2, with the undersides of the support platforms immediately above the keyboard keys. Since the thin forward portions of the support platforms 34 and 36 extend forward beyond the frame members 66, 68 and 70, 72, the upper surfaces of the support platforms 34 and 36, upon which the keyboard operator rests his/her palm heels, wrists and forearms, extend in a plane substantially parallel to and preferably parallel to the upper surfaces of the keyboard keys with the palm heels, wrists and forearms of the operator only slightly elevated above the upper surfaces of the keyboard keys 32. The forward portions of the support platforms 34 and 36 extend beyond the frame members 66, 68 and 70, 72 a sufficient distance that the forward edges 50 and 52 of the support platforms can preferably overlap at least a portion of the first row 78 of keyboard keys (typically the space bar row) when the primary carriages 38 and 40 are in their most forward position and, most preferably, at least a portion of the second row 80 of keyboard keys (typically the Z, X, C, V, B, etc. row) when the primary carriages 38 and 40 are in their most forward position. This enables a keyboard operator with small hands to reach the last row 82 of the keyboard keys (typically the function key row) when the support platforms 34 and 36 are in their forward most positions with little or no flexion or extension movements of the wrists and without having to move his/her palm heels, wrists and forearms from the support platforms 34 and 36.

The tracks 76 are preferably in the form of elongated channels with upper and lower surfaces 84 and 86 that confine the wheels or rollers 74 of the primary carriages 38 and 40 so that the support platforms 34 and 36 move in their intended plane of movement and can not be tipped out of their intended plane of movement by pressing down on the forward or trailing edge portions of the support platforms.

The secondary carriages 42 and 44 are each provided with vertical end plates 88 and 90 that support the tracks 76 and have pairs of wheels or rollers 92 rotatably mounted thereon. The wheels or rollers 92 are received within the tracks 94 of the base track assembly 46 and are preferably provided with annular flanges 93 to help keep the wheels properly aligned in the tracks 94. The tracks 94 are preferably in the form of elongated channels with upper and lower surfaces 96 and 98 that confine the wheels or rollers 92 of the secondary carriages 42 and 44 so that the secondary carriages 42 and 44 can not lift out of the tracks 94.

The tracks 76 have a length in the "X" direction that permits the support platforms 34 and 36 to move in the "X" direction between: a) a forward most position where the forward edges 50 and 52 of the support platforms 34 and 36 typically overlap a portion of the keyboard 22, preferably overlap at least a portion of the first row 78 of keyboard keys, and most preferably, overlap at least a portion of the second row 80 of keyboard keys so that even an operator with small hands, such as a child, can reach the last row 82 of keyboard keys with his/her fingers without moving his/her palm heels, wrists or forearms from the support platforms and little or no flexing or extending his/her wrists and b) a rearward most position where the forward edges 50 and 52 of the support platforms do not overlap or extend over the first row of keyboard keys 78 and preferably are spaced in the "X" direction at least one half of an inch and most preferably at least one and one half inches from the operator facing base edges of the keys in the first row 78 of keyboard keys so that the operator can reach the first row 78 of keyboard keys with his/her fingers without moving his/her palm heels, wrists or forearms from the support platforms and with little or no flexing or extending his/her wrists.

By way of example, the length of movement in the "X" direction of the support platforms 34 and 36 ranges from about one to about four inches and most preferably between about three to about three and one half inches to obtain the desired movement in the "X" direction of the support platforms between the forward most and the rearward most positions. The movement of the support platforms in the "X" direction permits the heel palm, wrist and forearm support apparatus of the present invention to be very versatile, e.g. operators with very small hands and short fingers may choose to operate the palm heel, wrist and forearm support apparatus 20 with the support platforms 34 and 36 relatively close to and at the forward most positions and operators with very large hands and long fingers may choose to operate the heel palm, wrist and forearm support apparatus 20 with the support platforms 34 and 36 relatively close to and at the rearward most positions.

The tracks 94 in the base track assembly 46 typically extend for about the width of the keyboard 22 in the "Y" direction so that the operator can reach all of the keyboard keys in any keyboard row, e.g. about eighteen inches for a typical computer keyboard. However, the tracks 94 can extend beyond either or both sides of the computer keyboard so that the operator can work with a mouse on a pad adjacent one or both sides of the computer keyboard. The tracks 94 of the base track assembly 46 are spaced out from the front of the keyboard 22 a distance that assures that the movement of the primary carriages 38 and 40 along the tracks 76 of the secondary carriages 42 and 44 can move the support platforms 34 and 36 between the forward most and rearward most positions discussed above.

Figure 4:
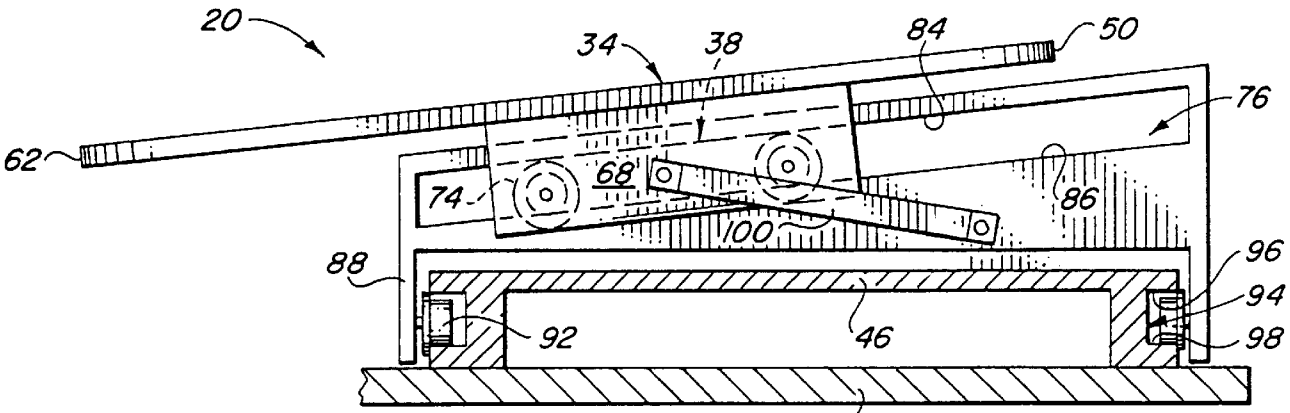
FIG. 4 is a section through the mobile hand, wrist and forearm support of FIG. 1 taken substantially along lines 4—4 of FIG. 3.

In the preferred embodiment, the support platforms 34 and 36 are biased toward their forward most positions. As shown in FIG. 4, this can be accomplished by connecting the primary carriages 38 and 40 to the secondary carriages 42 and 44 by means of elastic bands 100. The elastic band 100 shown is in an somewhat extended condition and urges the primary carriage 38 forward. While an elastic band is shown as the biasing means, coil springs or other conventional means for biasing the primary carriages forward can also be used. The use of the biasing means to move the primary carriages 38 and 40 forward when not in use keeps the support platforms 34 and 36 out of the way of the operator when the operator is not using the keyboard 22.

Figure 5:
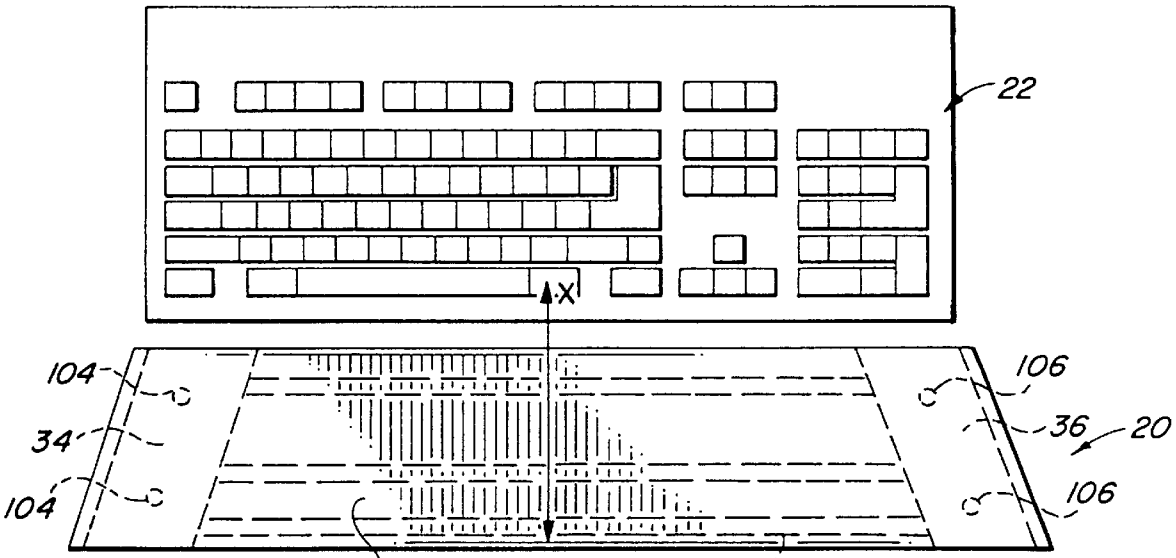
FIG. 5 is a schematic view of the mobile hand, wrist and forearm support of FIG. 1 with a cover plate that allows one hand, wrist and forearm to move the cover plate and the other hand, wrist and forearm of a partially disabled operator fore and aft with respect to the keyboard.

FIG. 5 schematically shows a cover plate 102 that can overlay and be detachably secured to the support platforms 34 and 36. As shown the underside of the cover plate 102 is provided with pair of pegs 104 and 106 which are received within openings in the support platforms 34 and 36 and reinforcing ribs 108 which extend between the inside lateral edges 58 and 60 of the support platforms to keep the cover plate 102 from sagging. Due to the width in the "Y" direction of the cover plate 102, the cover plate 102 can only be moved in the "X" direction. However, for a keyboard operator who is partially disabled, the application of the cover plate 102 to the support platforms enables the operator to use one hand, wrist and forearm to move the fingers of other hand, on the partially disabled side of the operator, over the keyboard in the "X" direction so that the operator can use the fingers of both hands to operate the keyboard. While the pairs of pegs 104 and 106 are shown securing the cover plate 102 to the support platforms 34 and 36, the cover plate could also be secured to the support platforms 34 and 36 by clamps, screws or similar fastening means. It is also contemplated that the cover plate 102 could be substitute for the support plates 34 and 36 by securing the cover plate 102 directly to the primary carriages 38 and 40.

Figure 6:
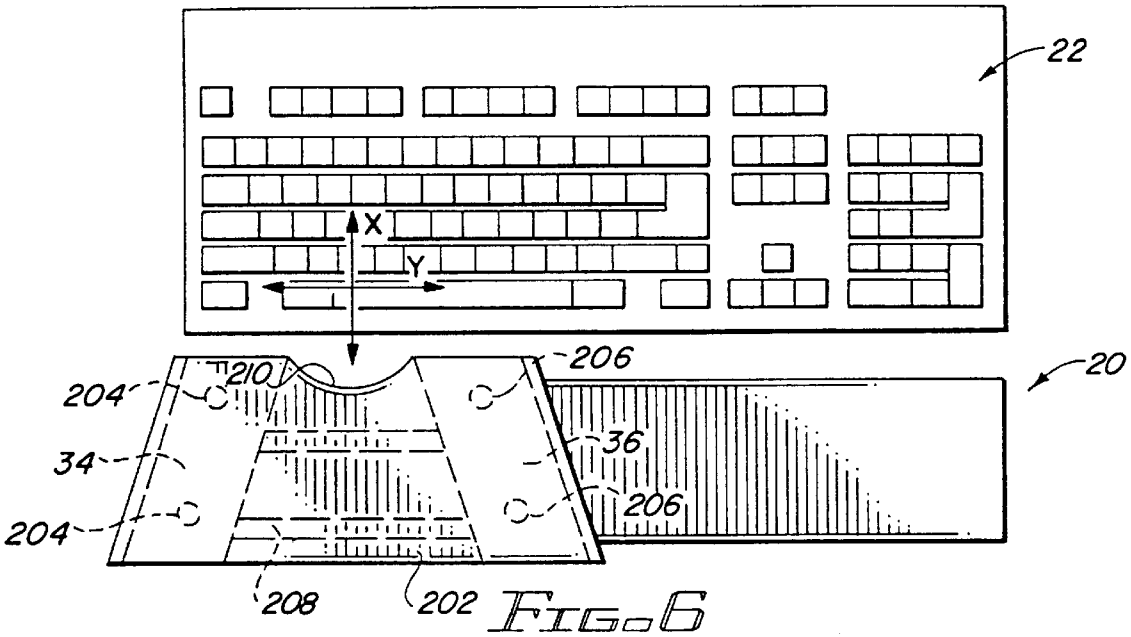
FIG. 6 is a schematic view of the mobile hand, wrist and forearm support of FIG. 1 with a cover plate that allows one hand, wrist and forearm to move the cover plate and the other hand, wrist and forearm of a partially disabled operator both fore and aft and from side to side with respect to the keyboard.

FIG. 6 schematically shows a second cover plate 202 that can overlay and be detachably secured to the support platforms 34 and 36. As shown the underside of the cover plate 202 is provided with pairs of pegs 204 and 206 which are received within openings in the support platforms 34 and 36 and reinforcing ribs 208 which extend between the inside lateral edges 58 and 60 of the support platforms to keep the cover plate 202 from sagging. Typically, the second cover plate separates the support platforms 34 and 36 by about four inches at the forward edges 50 and 52 of the support platforms 34 and 36. Due to the width, in the "Y" direction, of the cover plate 202, the cover plate 202 can be moved in both the "X" direction and the "Y" direction. In addition, the forward edge 210 of the cover plate is preferably provided with a concave edge portion to facilitate the use of the operator's thumbs when operating the keyboard 22. For a keyboard operator who is partially disabled, the application of the cover plate 202 to the support platforms enables the operator to use one hand, wrist and forearm to move the fingers of other hand, on the partially disabled side of the operator, over the keyboard in both the "X" direction and the "Y" direction so that the operator can use the fingers of both hands to operate the keyboard. While the pairs of pegs 204 and 206 are shown securing the cover plate 202 to the support platforms 34 and 36, the cover plate could also be secured to the support platforms 34 and 36 by clamps, screws or similar fastening means. It is also contemplated that the cover plate 202 could be substituted for the support plates 34 and 36 by securing the cover plate 202 directly to the primary carriages 38 and 40.

FIGS. 7–11 show a second embodiment 120 of the palm heel, wrist and forearm support apparatus of the present invention positioned in front of a typical computer keyboard 22. While a computer keyboard is shown, the palm heel, wrist and forearm support apparatus of the present invention can be used with other keyboards, such as but not limited to, typewriter keyboards, calculator keyboards and similar keyboards.

The palm heel, wrist and forearm support apparatus 120 is, preferably, mounted on and secured to a base plate 124 by adhesives, screws or other fasteners, not shown, or is integral with the base plate 124 which also carries or supports the keyboard 22. The base plate 124 can be made of a polymeric sheet material, wood, metal or the like, but preferably is made of a polymeric sheet material. The base plate 124 is preferably provided with keyboard support pads 126 upon which the keyboard 22 is positioned relative to the palm heel, wrist and forearm support apparatus 120. The keyboard support pads 126 are identical to the keyboard support pads 26 shown in FIGS. 12 and 13 and described in connection with the preferred embodiment 20 of this invention and permit the height of the keyboard 22 to be adjusted relative to the palm heel, wrist and forearm support apparatus 120.

As shown in FIGS. 7–11, the palm heel, wrist and forearm support apparatus 120 includes a pair of support platforms 134 and 136; a pair of primary carriages 138 and 140 on which the support platforms 134 and 136 are mounted; a pair of secondary carriages 142 and 144 on which the primary carriages 138 and 140 are slidably mounted; and a base rail assembly 146 on which the secondary carriages 142 and 144 are slidably mounted. The above components of the palm heel, wrist and forearm support apparatus 120 can be made of polymeric materials (e.g. molded plastics), metals (e.g. aluminum, stainless steel) or similar materials.

The left and right support platforms 134 and 136 of the palm heel, wrist and forearm support apparatus 120 can be moved in both the "X" direction (perpendicular to the keyboard 22 and the rows 48 of keyboard keys) and the "Y" direction (parallel to the keyboard 22 and the rows 48 of keyboard keys). Preferably, the support platforms 134 and 136 are made of a thin sheet material about ⅛ of an inch thick.

The support platforms 134 and 136 are sized to comfortably support the palm heels, wrists and forearms of the keyboard operator and typically have a length in the "X" direction of about seven and one half inches, preferably extending about one half of the way or more from the wrist to the elbow of the keyboard operator, and a width in the "Y" direction of about four and one half inches. The forward edges 150 and 152 of the support platforms 134 and 136 can be somewhat rounded, as shown, or the forward edges 150 and 152 of the support platforms 134 and 136 can be substantially straight and extend generally in the "Y" direction or parallel to the key rows 48 with or without cutouts for the thumbs, such as platforms 34 and 36 of FIG. 1. The outside lateral edges 154 and 156 and the inside lateral edges 158 and 160 of the support platforms 134 and 136 are preferably inclined inwardly toward the forward edges 150 and 152 of the support platforms, e.g. at an angle of about 15° to the "X" direction. Since the forearms of the keyboard operator are also going to be inclined inwardly toward the keyboard 22, the angular orientation of the lateral edges 154, 156, 158 and 160 reduces the surface area of the support platforms 134 and 136 and saves on material costs without lessening the support provided to the palm heels, wrists and forearms of the keyboard operator. The configurations of the trailing edges 162 and 164 of the support platforms 134 and 136 may vary. However, all of the corners of the support platforms 134 and 136 are preferably rounded to prevent the support platforms from snagging onto the keyboard operator's clothing.

Figure 8:
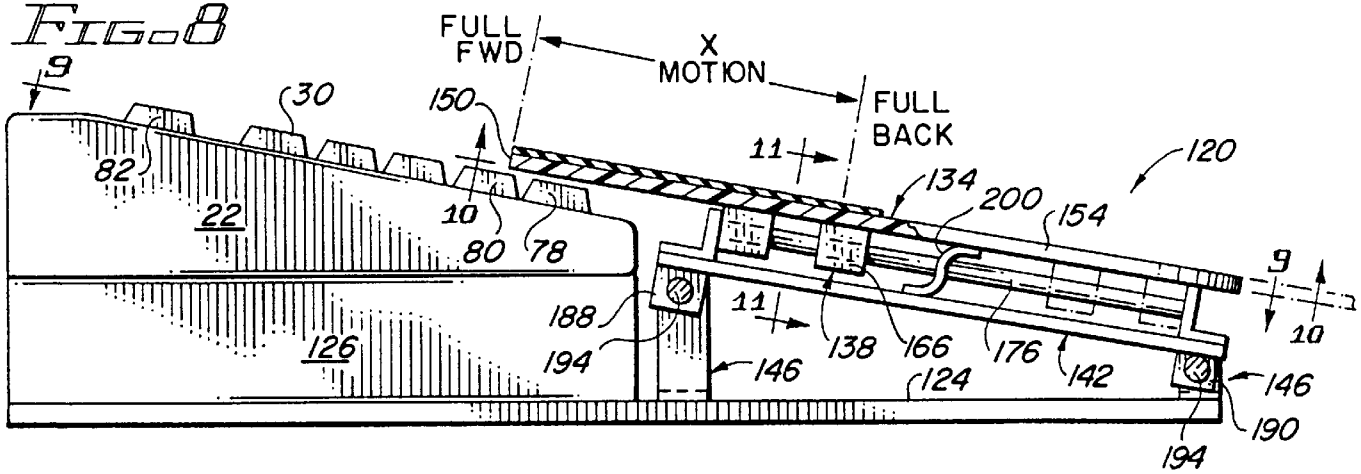
FIG. 8 is a section through the mobile hand, wrist and forearm support of FIG. 7 taken substantially along lines 8—8 of FIG. 7.
Figure 7:
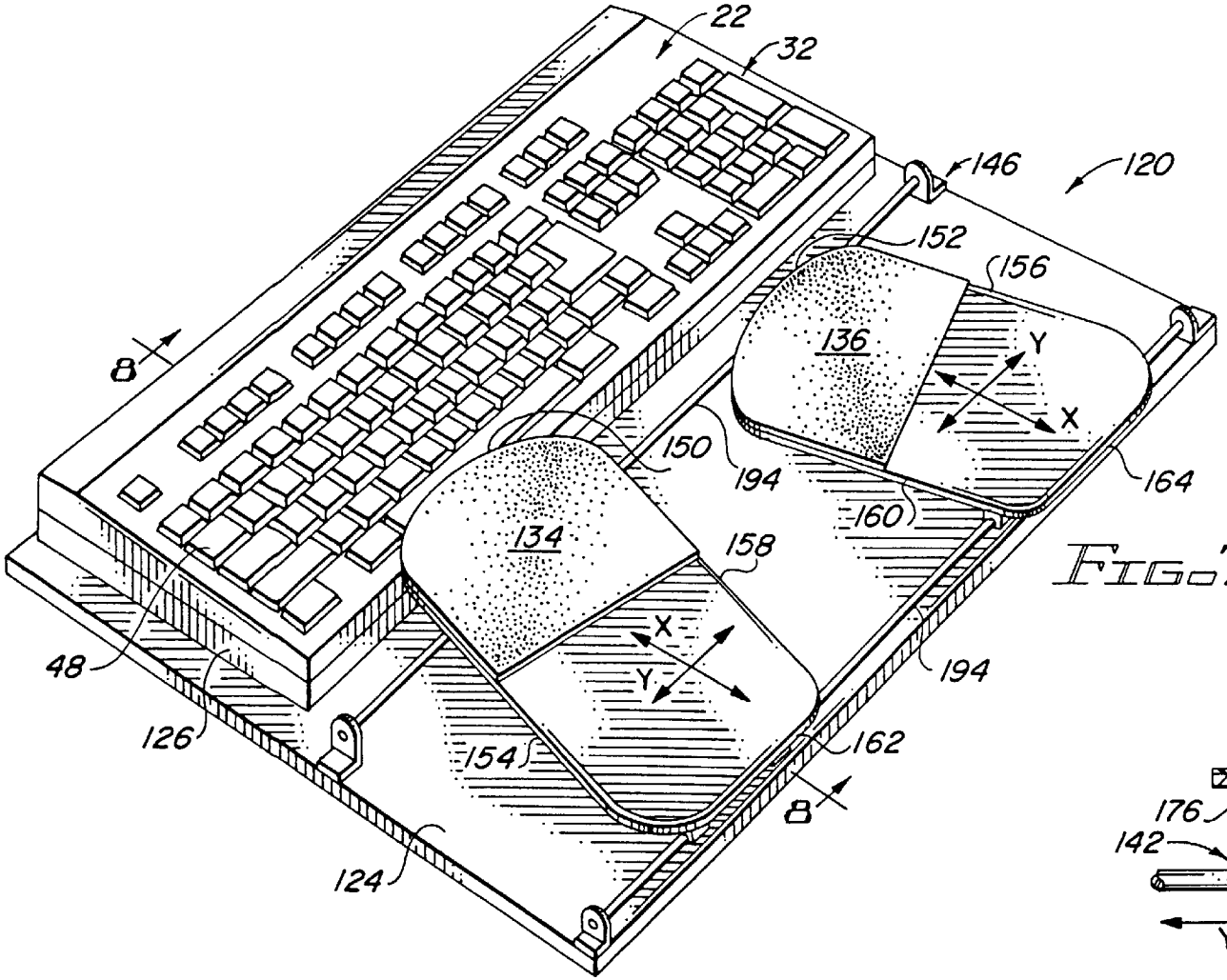
FIG. 7 is a perspective view of a second embodiment of the mobile hand, wrist and forearm support of the present invention positioned before a typical computer keyboard.
Figure 11:
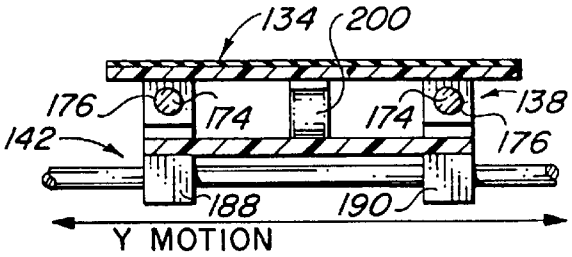
FIG. 11 is a section of a support platform and carriage assembly taken substantially along lines 11—11 of FIG. 8.
Figure 9:
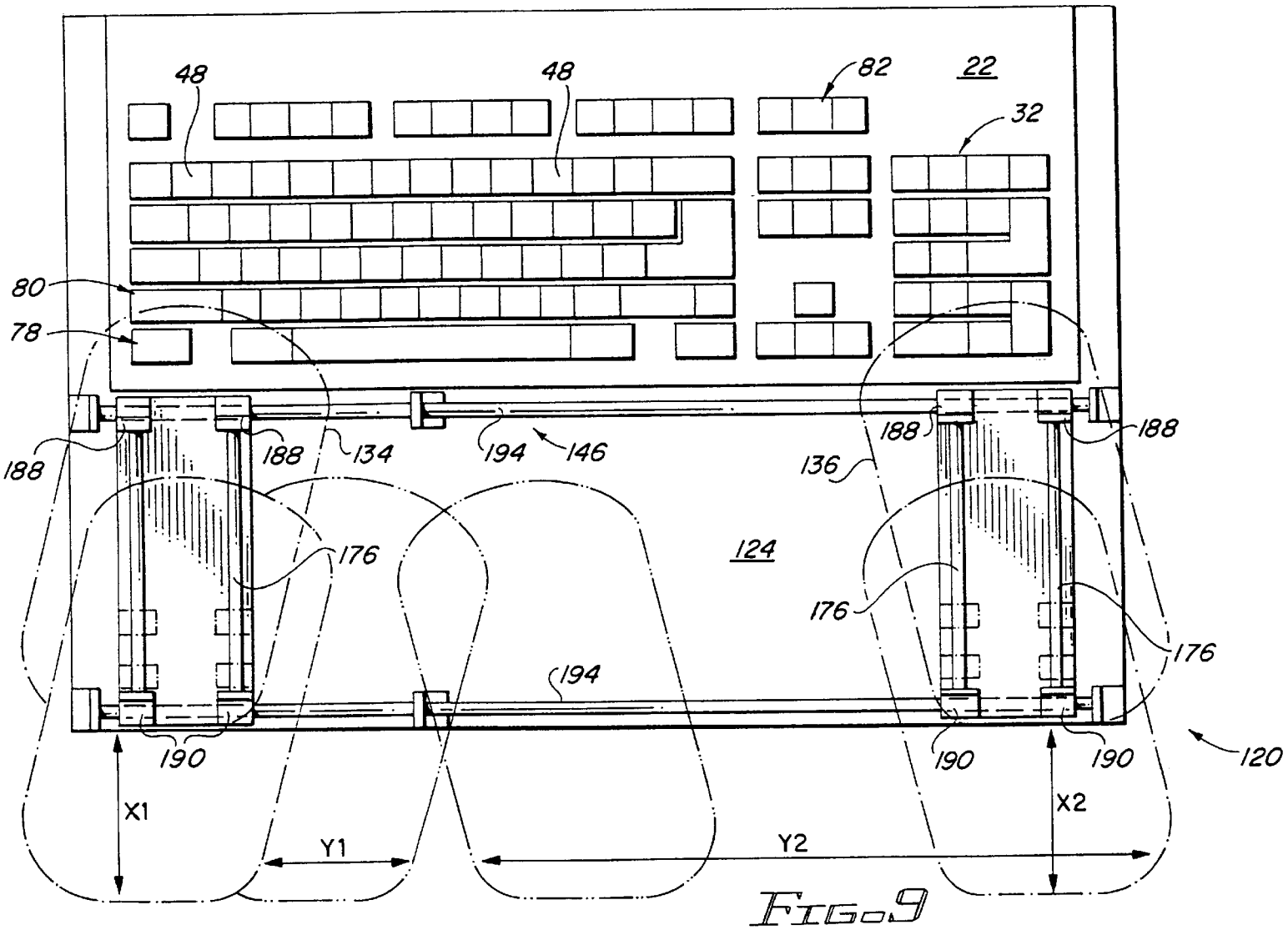
FIG. 9 is a plan view of the mobile hand, wrist and forearm support of FIG. 7 taken substantially along lines 9—9 of FIG. 8.
Figure 10:
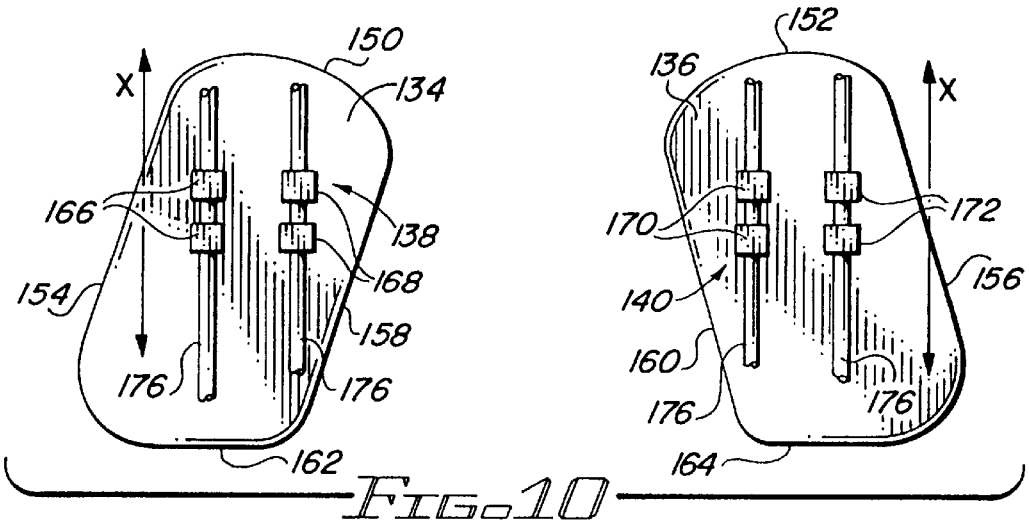
FIG. 10 is an underside view of the hand, wrist and forearm support platforms of the hand, wrist and forearm support of FIG. 7 taken substantially along lines 10—10 of FIG. 8.

The support platforms 134 and 136 are mounted on primary carriages 138 and 140. As best shown in FIGS. 8, 10 and 11, the primary carriages 138 and 140 each include a two pair of sleeve members 166, 168 and 170, 172 integral with or secured to the undersides of the support platforms 134 and 136 and having bores 174 extending therethrough in the "X" direction. The bores 174 of each sleeve member are slidably mounted on parallel support rails 176 of the secondary carriages 142 and 144. The parallel support rails 176 of the secondary carriages 142 and 144 extend in the "X" direction and are inclined to the horizontal at an angle substantially equal to or, preferably, equal to the angle to the horizontal of the plane containing the upper surfaces 30 of the keyboard keys 32. With this construction, the support platforms 134 and 136 can be extended over the keyboard keys 32, as shown in FIGS. 7 and 8, with the undersides of the support platforms immediately above the keyboard keys. Since the thin forward portions of the support platforms 134 and 136 extend forward beyond the sleeve members 166, 168 and 170, 172, the upper surfaces of the support platforms 134 and 136, upon which the keyboard operator rests his/her palm heels, wrists and forearms, extend in a plane substantially parallel to and preferably parallel to the upper surfaces of the keyboard keys with the palm heels, wrists and forearms of the operator only slightly elevated above the upper surfaces of the keyboard keys 32. The forward portions of the support platforms 134 and 136 extend beyond the sleeve members 166, 168 and 170, 172 a sufficient distance that the forward edges 150 and 152 of the support platforms can preferably overlap at least a portion of the first row 78 of keyboard keys (typically the space bar row) when the primary carriages 138 and 140 are in their most forward position and, most preferably, at least a portion of the second row 80 of keyboard keys (typically the Z, X, C, V, B, etc. row) when the primary carriages 138 and 140 are in their forward most position. This enables a keyboard operator with small hands to reach the last row 82 of the keyboard keys (typically the function key row) without having to move his/her hands from the support platforms 134 and 136 when the support platforms 134 and 136 are in their forward most positions with little or no flexion or extension movements of the wrists and without having to move his/her palm heels, wrists and forearms form the support platforms 134 and 136.

The bores 174 in the sleeve members and support rails 176 are preferably coated or treated with teflon or some other material to facilitate the gliding movement of the support platforms 134 and 136 in the "X" direction. With the support rails 176 passing through the bores 174, the support platforms 134 and 136 can not be tipped out of their intended plane of movement by pressing down on the forward or trailing edge portions of the support platforms.

The undersides of the secondary carriages 142 and 144 are each provided with pairs of sleeve members 188 and 190 that are slidably mounted on parallel support rails 194 of the base rail assembly 146. The support rails 194 extend in the "Y" direction and with the support rails passing through the sleeve members 188 and 190 of the secondary carriages 142 and 144, the secondary carriages 142 and 144 can not lifted out of their intended plane of motion.

The support rails 176 have a length in the "X" direction that permits the support platforms 134 and 136 to move in the "X" direction between: a) a forward most position where the forward edges 150 and 152 of the support platforms 134 and 136 typically overlap a portion of the keyboard 22, preferably overlap at least a portion of the first row 78 of keyboard keys, and most preferably, overlap at least a portion of the second row 80 of keyboard keys so that the operator can reach the last row of keyboard keys with his/her fingers without moving his/her palm heels, wrists or forearms from the support platforms and little or no flexing or extending his/her wrists and b) a rearward most position where the forward edges 150 and 152 of the support platforms do not extend over the first row of keyboard keys 78 and preferably are spaced in the "X" direction at least one half of an inch and most preferably at least one and one half inches from the operator facing base edges of the keys in the first row 78 of keyboard keys so that the operator can reach the first row 78 of keyboard keys with his/her fingers without moving his/her palm heels, wrists or forearms from the support platforms and with little or no flexing or extending his/her wrists.

By way of example, the length of movement in the "X" direction of the support platforms 134 and 136 ranges from about one to about four inches and most preferably between about three to about three and one half inches to obtain the desired movement in the "X" direction of the support platforms between the forward most and the rearward most positions. The movement of the support platforms in the "X" direction permits the heel palm, wrist and forearm support apparatus of the present invention to be very versatile, e.g. operators with very small hands and short fingers may choose to operate the palm heel, wrist and forearm support apparatus 120 with the support platforms 134 and 136 relatively close to and at the forward most positions and operators with very large hands and long fingers may choose to operate the heel palm, wrist and forearm support apparatus 120 with the support platforms 134 and 136 relatively close to and at the rearward most positions.

The support rails 194 in the base rail assembly 146 typically extend for about the width of the keyboard 22 in the "Y" direction so that the operator can reach all of the keyboard keys in any keyboard row, e.g. about eighteen inches for a typical computer keyboard. However, the support rails 194 can extend beyond either or both sides of the computer keyboard so that the operator can work with a mouse on a pad adjacent one or both sides of the computer keyboard. The support rails 194 of the base rail assembly 146 are spaced out from the front of the keyboard 22 a distance that assures that the movement of the primary carriages 138 and 140 along the support rails 176 of the secondary carriages 142 and 144 can move the support platforms 134 and 136 between the forward most and rearward most positions discussed above.

Preferably, the support platforms 134 and 136 are biased toward their forward most positions. As shown in FIGS. 8 and 11, this can be accomplished by connecting the undersides of the support platforms 134 and 136 to the upper sides of the secondary carriages 142 and 144 by means of elastic bands 200. The elastic band 200, shown in FIG. 8, is in an somewhat extended condition and urges the support platform 134 forward. While an elastic band is shown as the biasing means, coil springs or other conventional means for biasing the primary carriages forward can also be used. The use of the biasing means to move the support platforms 134 and 136 forward when not in use keeps the support platforms 134 and 136 out of the way of the operator when the operator is not using the keyboard 22.

The cover plates 102 and 202, shown and described in connection with FIGS. 5 and 6 and the preferred embodiment 20 of the present invention, can also be applied in a similar manner to the support platforms 134 and 136 of embodiment 120.

FIGS. 14, 14A, 14B and 14C show an embodiment of the present invention wherein the support carriages are provided with brake assemblies that permit the support platform(s) to be selectively retained in a stationary position by applying at least a selected downward force on the support platform(s) and moved by applying less than the selected downward force on the support platform(s). Where two support platforms are utilized on the support apparatus 20, the support platforms can be retained in a stationary position or moved independently of each other through the discretionary application of the downward force or the discretionary release of the downward force on either or both of the support platforms. The selected downward force is preferably selected so that the support platform(s) normally move(s) when the operator's palm heel(s), wrist(s) and forearm(s) are at rest on the support platform(s) and the support platform(s) remain (s) stationary when an additional downward force is intentionally applied to the support platform(s) by the operator through the operator's palm heel(s), wrist(s) and/or forearm (s). Although not preferred, the selected downward force can be selected so that the support platform(s) normally remain (s) stationary when the operator's palm heel(s), wrist(s) and forearm(s) are at rest on the support platform(s) and the support platform(s) can be moved when less downward force is intentionally applied to the support platform(s) by the operator through the palm heel(s), wrist(s) and/or forearm(s).

As shown in FIGS. 14, 14A, 14B and 14C, a primary carriage 302 and a secondary carriage 304 are each provided with sets of brake assemblies 306 and 308 for retaining the carriages 302 and 304 in stationary positions when at least a selected force is applied to the support platform 310. While only one primary carriage, one secondary carriage and one support platform are shown with the brake assemblies in FIGS. 14, 14A, 14B and 14C, the brake assemblies 306 and 308 would normally be utilized on both sets of primary and secondary carriages, such as the sets of primary and secondary carriages shown in FIGS. 1–6 and 16. Where only the ability to hold the support platform(s) stationary in the direction parallel to the rows of keyboard keys is desired, the brake assemblies 306 are not utilized. Then, although the support platform(s) are kept from moving in a direction parallel to the rows of keyboard keys when the brake assemblies 308 are actuated, the support platform(s) can then still be moved back and forth in the direction perpendicular to the rows of keyboard keys.

Since the brake assemblies 306 and 308 can each have the same structure (axle support 312 and coil spring 314), only the structure of one of the brake assemblies 308 will be shown and described in detail. The primary carriage 302 and the secondary carriage 304 each have four brake assemblies which operate in conjunction with the carriage wheels to brake the carriages. When at least the selected downward force is applied to a support platform, such as support platform 310, the axle supports 312 for the secondary carriage wheels move upward relative to the secondary carriage 304, as shown in FIG. 14B, compressing the coil springs 314 until the bottom surface 316 of the carriage 304 is forced against the upper surface of the base plate 24 to retain the secondary carriage in place. Similarly, the axle supports 312 for the primary carriage wheels move upward relative to the primary carriage 302 and the support platform 310 compressing the coil springs 314 until the bottom surface of the support platform 310 is forced against the upper surface of the secondary carriage 304 to retain the primary carriage in place. When the downward force is lessened to less than the selected downward force, the coil springs 314 move the undersides of the secondary carriage 304 and the support platform 310 out of contact with the upper surfaces of the base plate 24 and the secondary carriage respectively and the carriages are free to move.

While coil springs, such as coil springs 314, are preferred other means could be used to place a resilient upward force on the carriages in opposition to the selected downward force. In addition, the upward force exerted by the coil springs could be adjusted by providing coil springs of different anti-compressive strengths, e.g. relatively light, medium and high anti-compressive strengths, or by providing conventional means for adjusting the initial anti-compressive force exerted by a set of the coil springs to a relatively light, medium or high setting.

Figures 16, 17:
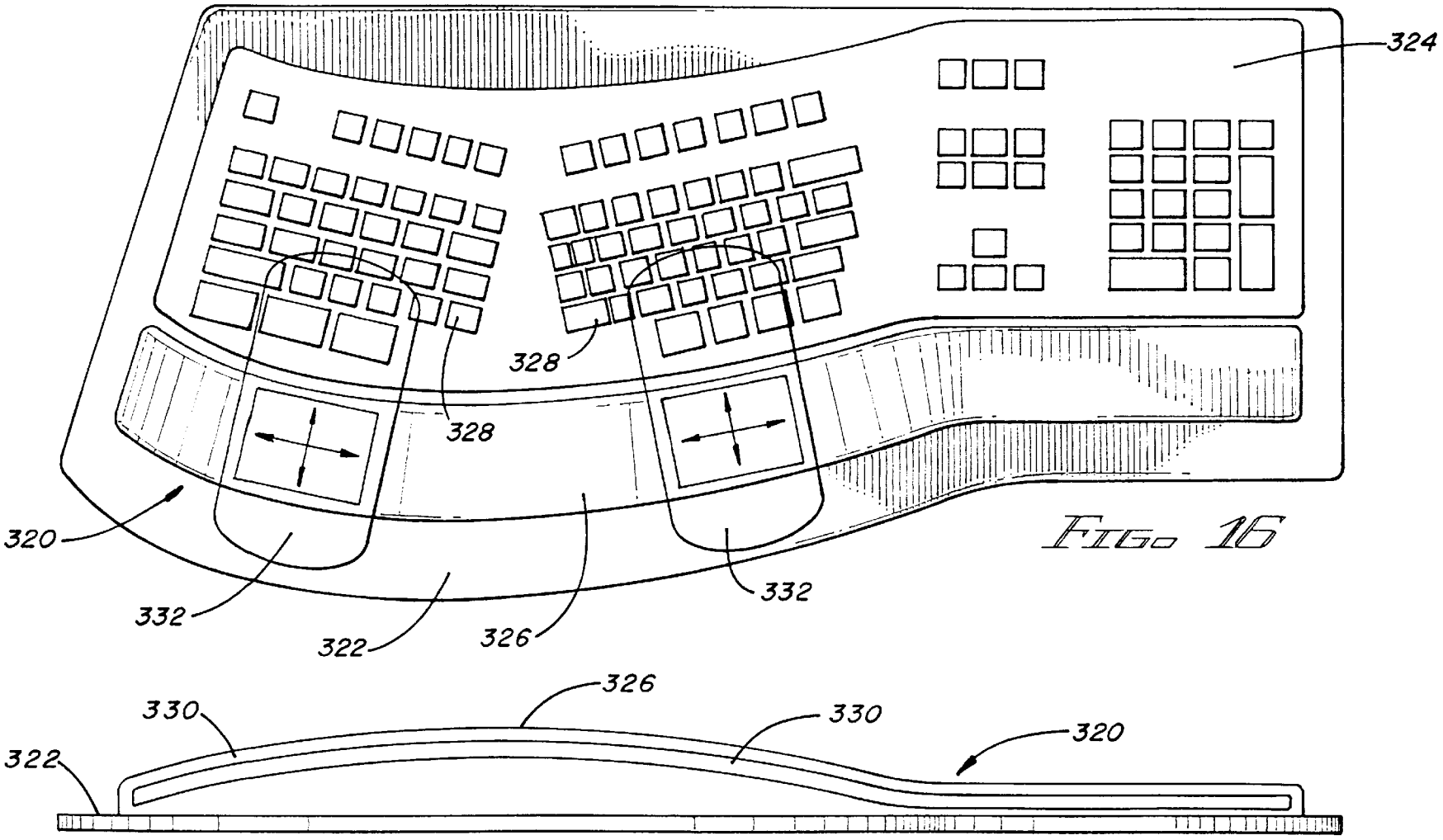
FIG. 16 is a plan view an embodiment of the support apparatus of the present invention when used with a keyboard wherein the rows of keys are nonlinear.
FIG. 17 is a front vertical view of the base track assembly of FIG. 16 without the support platforms and support platform carriages thereon.

FIGS. 16 and 17 show an embodiment of the present invention with which the utilization of the brake assemblies 306 and particularly, the brake assemblies 308 is especially suited. As shown in FIGS. 16 and 17, the tracks 320 of the base plate 322 follow the contour of the keyboard 324, e.g. a MICROSOFT natural keyboard, both in a horizontal plane and a vertical plane. Thus, tracks 320 have a nonlinear section 326 that extends parallel to the rows of keyboard keys 328, as shown in FIG. 16, and is raised as shown in FIG. 17. By using the brake assemblies 308 on the secondary carriages, the secondary carriages can be held in place on the sloping portions 330 of the nonlinear section 326 so that the secondary carriages and the support platforms 332 do not move parallel to the rows of keyboard keys 328. If desired the brake assemblies can also be used on the primary carriages to hold the primary carriages and the support platforms 332 in place so that they do not move perpendicular to the rows of keyboard keys 328.

Figure 14:
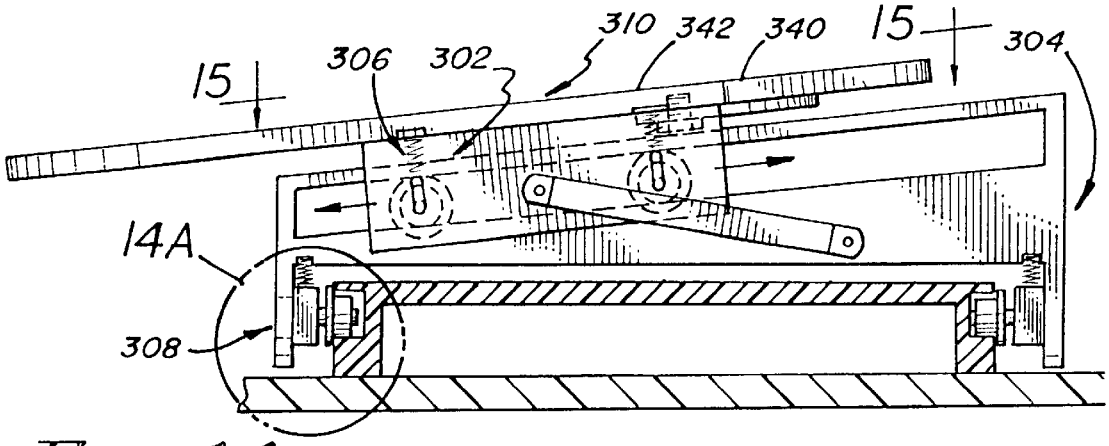
FIG. 14 is a vertical section through the base track assembly and a carriage assembly provided with brake assemblies to retain the support platform stationary by exerting downward pressure.
Figure 14A:
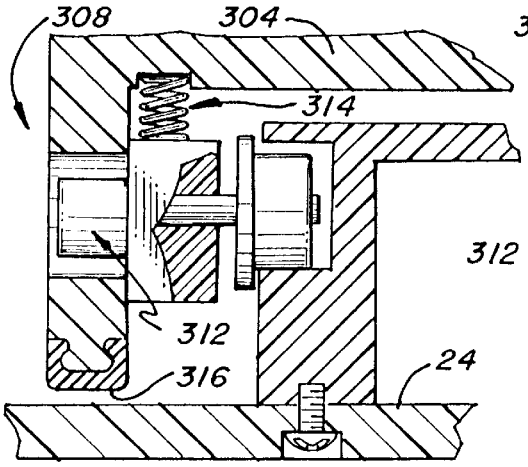
FIGS. 14A to 14C are details of the brake assembly circled in FIG. 14.
Figure 14B:
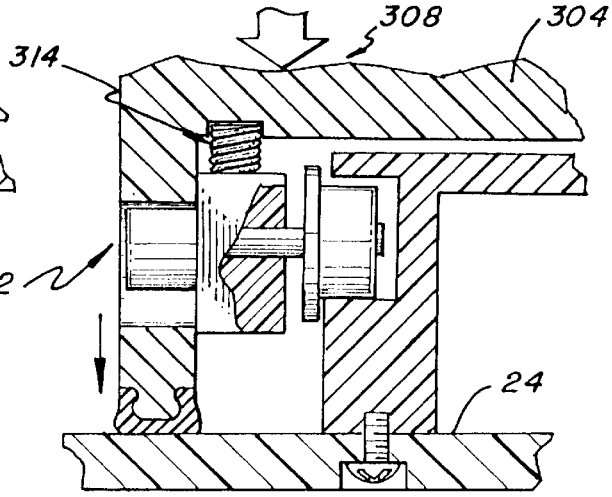
Figure 14C:
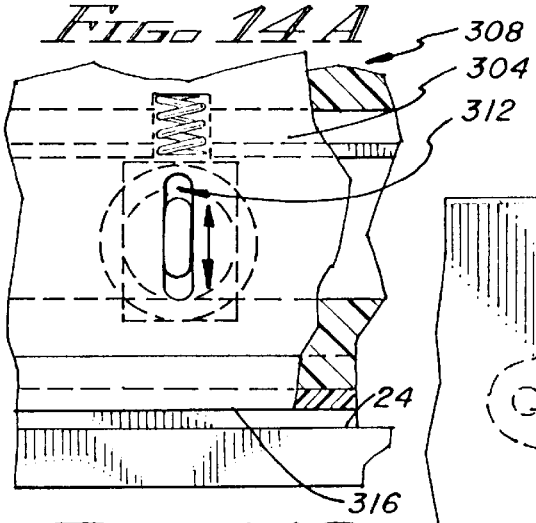
Figure 15:
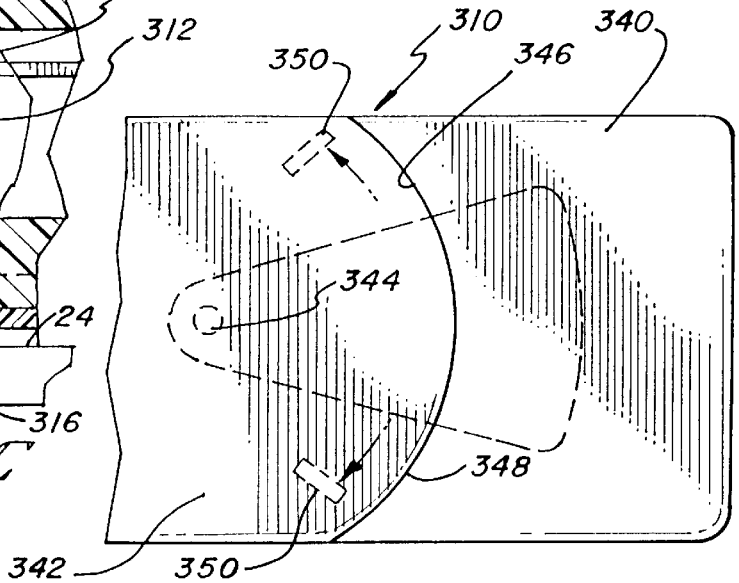
FIG. 15 is a plan view of the support platform shown in FIG. 14, taken substantially along lines 15—15.

FIG. 15 shows a plan view of the support platform 310 that is also shown in FIG. 14. The support platform 310 can be used on the embodiments of the invention shown in FIGS. 1–4, 7–11, and 16, in place of the support platforms shown in those FIGS. Support platform 310 includes a forward portion 340 and a rearward portion 342. The forward portion 340 is pivotally mounted to the rearward portion 342 by pin 344 that permits the forward portion to pivot about an axis perpendicular to the plane of the upper surface of the support platform 310. The adjacent edges 346 and 348 of the forward portion 340 and the rearward portion 342, respectively, are each semicircular and complementary to each other to facilitate the pivotal movement of the forward portion 340 relative to the rearward portion 342. Stops 350 on the underside of the rearward portion 342, limit the pivotal movement of the forward portion 340 and prevent the forward portion 340 from pivoting too far from its neutral position shown in FIG. 15. The operator, by placing the palm heel of his/her hand on the forward portion 340 of the support platform 310, can easily pivot the hand relative to the wrist to further facilitate manipulation of the keyboard keys while the palm heel, wrist and forearm remain supported in a common plane on the upper surface of the support platform to prevent any appreciable flexion or extension of the wrist.

Figures 18, 19, 20, 21, 22:
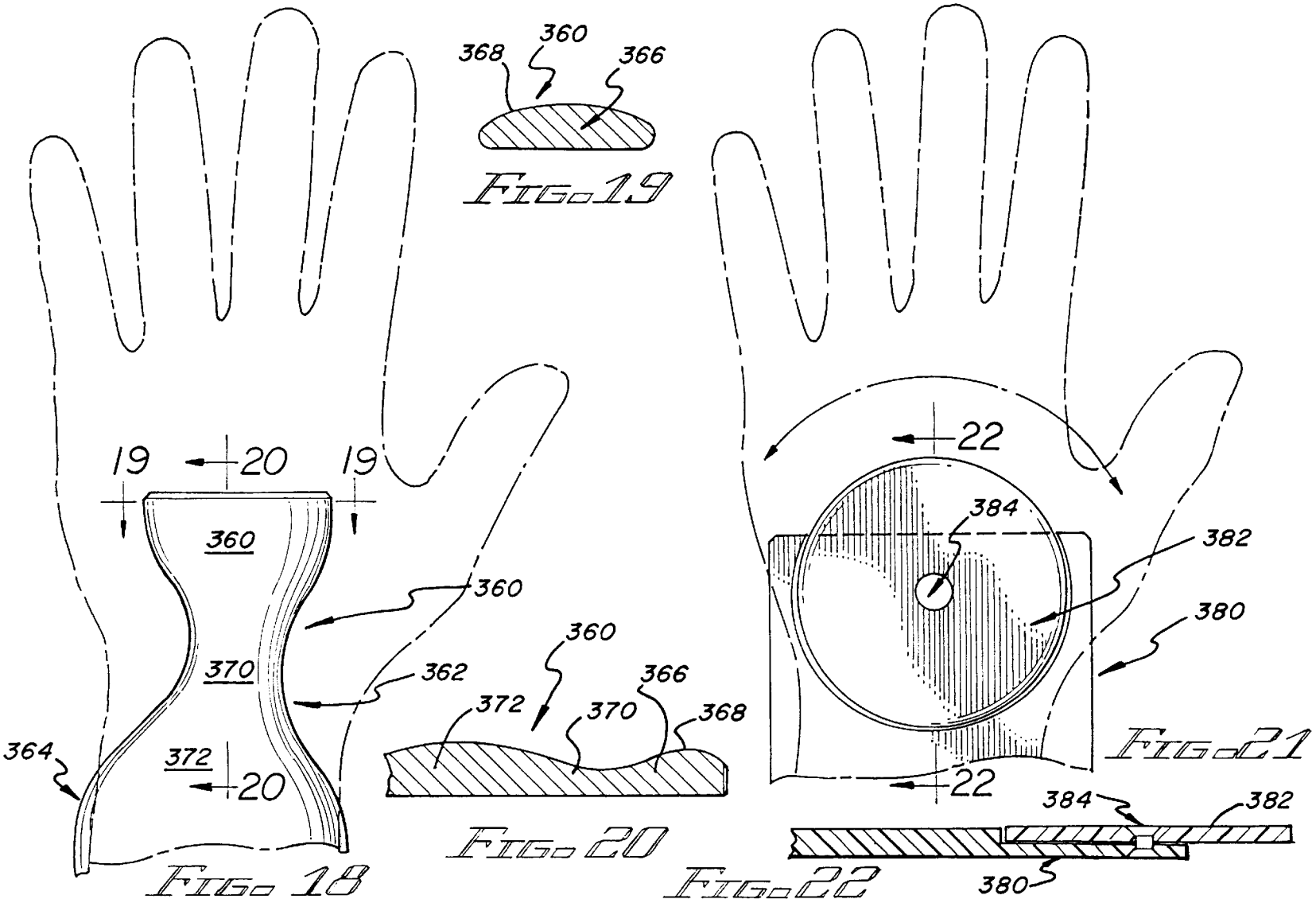
FIG. 18 is a plan view of a palm, palm heel and wrist portion of a support platform of the present invention.
FIG. 19 is a section the support platform of FIG. 18 taken substantially along lines 19—19 of FIG. 18.
FIG. 20 is a section the support platform of FIG. 18 taken substantially along lines 20—20 of FIG. 18.
FIG. 21 is a plan view of a palm, palm heel and wrist portion of a support platform of the present invention.
FIG. 22 is a section the support platform of FIG. 21 taken substantially along lines 22—22 of FIG. 21.

FIGS. 18–20 show a plan view and sectional views of another embodiment 360 of the support platform which looks somewhat like an hour glass from above and which can be used on the embodiments of the invention shown in FIGS. 1–4, 7–11, 14–14C, and 16, in place of the support platforms shown in those FIGS. Support platform 360 includes a forward portion 362 and a rearward portion 364 that extends rearward to support the forearm. The forward portion 362 includes a forward most portion 366 having a convex upper surface 368 contoured to be comfortably received in and support the palm of the operator's hand; a narrowed waist portion 370 having an upper surface contoured to be comfortably received under and support the operator's palm heel; and a rear portion 372 wider than the narrowed waist portion 370 and having an upper surface contoured to be comfortably received under and support the operator's wrist. The support platform 360, with its contoured forward portion 362, still supports the operator's palm heel, wrist and forearm in a common plane to prevent or essentially prevent the flexion or extension of the operator's wrist while permitting the operator to easily manipulate the keys of the keyboard.

FIGS. 21 and 22 show a plan view and a sectional view of another embodiment 380 of the support platform which can be used on the embodiments of the invention shown in FIGS. 1–4, 7–11, 14–14C, and 16, in place of the support platforms shown in those FIGS. FIGS. 21 and 22 show the forward portion of the support platform 380 which has a disk 382 upon which the operator's palm heel is placed. The remainder of the support platform 380 supports the operator's wrist and the forearm in a common plane with the palm heel. As shown, the disk 382 is rotatably mounted on the support platform by a pin 384 so that the operator can pivot his/her hand relative to the wrist to manipulate the keyboard keys while the palm heel, wrist and forearm are supported.

Figure 23:
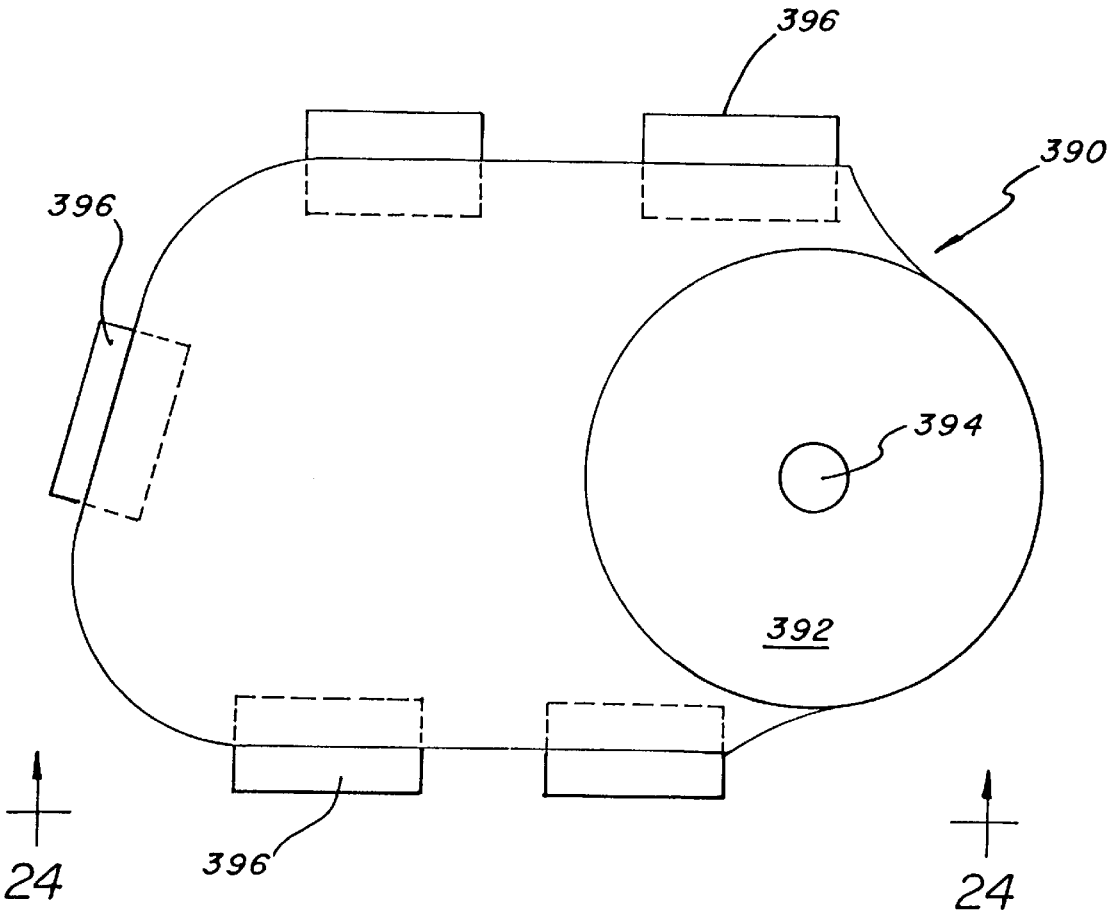
FIG. 23 is a plan view of a clip on support platform of the present invention that may be detachably mounted on support platforms such as those shown in FIGS. 1, 7 and 16.
Figure 24:
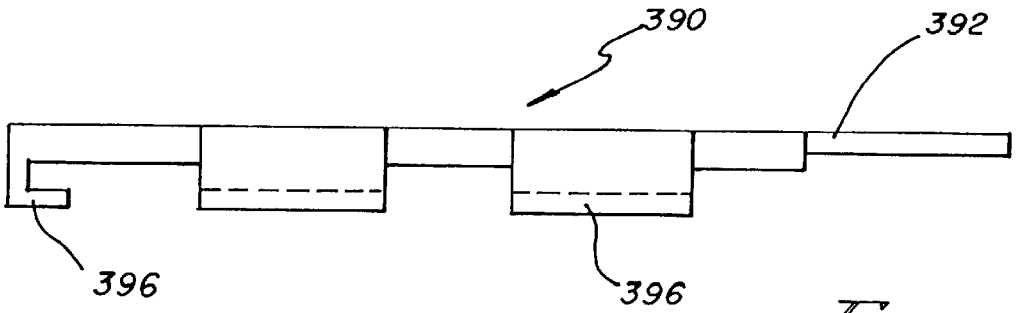
FIG. 24 is a side elevation of the clip on support platform of FIG. 23 taken substantially along lines 24—24 of FIG. 23.

FIGS. 23 and 24 show a plan view and a side view of another embodiment 390 of the support platform which can be clipped onto or otherwise detachably mounted on (e.g. pegs received in openings in the support platforms like those of the cover plates 102 and 202 of FIGS. 5 and 6) the support platforms shown in FIGS. 1–4, 7–11, and 16. FIGS. 23 and 24 show a disk 392, mounted on the forward portion of the support platform 390, upon which the operator's palm heel is placed. The remainder of the support platform 390 supports the operator's wrist and the forearm in a common plane with the palm heel. As shown, the disk 392 is rotatably mounted on the support platform by a pin 394 so that the operator can pivot his/her hand relative to the wrist to manipulate the keyboard keys while the palm heel, wrist and forearm are supported. In the preferred embodiment, the clip members 396 permit the support platform 390 to detachably mounted on the support platforms of FIGS. 1–4, 1–11 and 16 by sliding the support platform 390 over the platforms of these embodiments until the clip members 396 secure the support platform 390 in place.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A support apparatus for supporting the palm heels, wrists and forearms of an operator to minimize flexion and extension of the operator's wrists when operating keyboards, comprising:

first and second support platforms for supporting the palm heels, wrists and forearms of an operator relative to a keyboard; said support platforms having forward edges and rear edges and upper surfaces upon which the operator's palm heels, wrists and forearms rest while operating the keyboard keys; said upper surfaces of said support platforms lying in a first plane substantially parallel to and adjacent a second plane containing upper surfaces of keys of the keyboard so that the operator can operate the keyboard keys by flexion and extension of the fingers with substantially no flexion or extension of operator's wrists which along with the operator's palm heels and forearms remain essentially at rest on said upper surfaces of said support platforms while the keyboard is being operated; and carriage means for supporting said first and second support platforms independently of each other so that said first and second support platforms can be moved in said first plane in a first direction perpendicular to the keyboard rows between forward most positions where the operator can reach a last row of keyboard keys while the operator's palm heels, wrists and forearms remain at rest on said upper surfaces of said support platforms and rearward most positions where the operator can reach a first row of keyboard keys while the operator's palm heels, wrists and forearms remain at rest on said upper surfaces of said support platforms and in a second direction parallel to the keyboard rows whereby all keyboard keys can be operated by flexion and extension of the operator's fingers with substantially no flexion or extension of the operator's wrists which along with the operator's palm heels and forearms remain at rest on said upper surfaces of said support platforms; said carriage means including means for independently retaining said first and second support platforms in a stationary position when a selected downward force is applied to said support platforms and for independently permitting said first and second support platforms to be moved when less than said selected downward force is applied to said support platforms.

2. The support apparatus according to claim 1, wherein: said means for independently retaining said first and second support platforms in a stationary position and for independently permitting said first and second support platforms to be moved includes spring means responsive to the selected downward force to independently retain said first and second support platforms in a stationary position.

3. The support apparatus according to claim 1, wherein: said carriage means for supporting said first and said second support platforms can move said first and said second support platforms between about one inch and about four inches in said direction perpendicular to the rows of keyboard keys; and said forward edges of said first and second support platforms at least overlap a portion of the keyboard but extend no farther than to overlap a second row of keyboard keys adjacent said first row of keyboard keys when said first and second support platforms are in their forward most positions.

4. The support apparatus according to claim 3, wherein: said forward edges of said first and said second support platforms are spaced from a first row of the keyboard keys at least one half of an inch when said first and said second support platforms are in their rearward most positions.

5. The support apparatus according to claim 3 wherein: said forward edges of said first and said second support platforms are spaced from a first row of the keyboard keys at least one and one half inches when said first and said second support platforms are in their rearward most positions.

6. The support apparatus according to claim 1, wherein: said carriage means is positioned between the operator and the keyboard; and said carriage means comprises a first pair of carriages for carrying said support platforms secured to undersides of said support platforms and movable in said first direction; a second pair of carriages for carrying said first pair of carriages and moveable in said second direction; and a base member for carrying said second pair of carriages.

7. The support apparatus according to claim 6, wherein: said first pair of carriages have means biasing said first pair of carriages toward said forward most positions so that said support platforms rest in said forward positions when said support apparatus in not in use.

8. The support apparatus according to claim 7, wherein: said base member has a keyboard support means for supporting the keyboard relative to said support apparatus and adjusting the spacing between said first and second planes.

9. The support apparatus according to claim 6, wherein: said base member includes means for guiding said second pair of carriages in said second direction that is nonlinear both horizontally and vertically to maintain movement in said second direction of said second pair of carriages and said first and second support platforms parallel to the keyboard rows.

10. The support apparatus according to claim 1, wherein: at least one of said support platforms comprises pivot means adjacent its forward edge for permitting the palm heel and hand of the operator to pivot relative to the wrist while being supported by said pivot means.

11. The support apparatus according to claim 10, wherein: both of said support platforms comprise a pivot means.

12. The support apparatus according to claim 11, wherein: said pivot means is detachably mounted on said at least one of said support platforms.

13. The support apparatus according to claim 10, wherein: said pivot means is a disk rotatably mounted on said at least one of said support platforms to rotate about an axis perpendicular to said first plane.

14. The support apparatus according to claim 10, wherein: said pivot means is a forward portion of said at least one of said support platforms that is pivotally mounted to said at least one of said support platforms to pivot about an axis perpendicular to said first plane.

15. The support apparatus according to claim 1, wherein: each of said support platforms have a forward portion comprising a forward most portion having a convex upper surface contoured to be received in the palm of the hand; a narrowed waist portion having an upper surface contoured to be received under the palm heel of the hand; and rearward portion wider than said narrowed waist portion and having an upper surface contoured to be received under the wrist of the operator.

16. A support apparatus for supporting the palm heels, wrists and forearms of an operator to minimize flexion and extension of the operator's wrists when operating keyboards, comprising:

a support platform for supporting the palm heels, wrists and forearms of an operator relative to a keyboard; said support platform having a forward edge, a rear edge, and side edges and an upper surface upon which the operator's palm heels, wrists and forearms rest while operating the keyboard keys; said upper surface of said support platform lying in a first plane substantially parallel to and adjacent a second plane containing upper surfaces of the keyboard keys so that the operator can operate the keyboard keys by flexion and extension of the fingers with substantially no flexion or extension of operator's wrists which along with the operator's palm heels and forearms remain on said upper surface of said support platform; and carriage means for supporting said support platform so that said support platform can be moved in said first plane in a first direction perpendicular to the keyboard rows between a forward most position where the operator can reach a last row of keyboard keys while the operator's palm heels, wrists and forearms remain at rest on said upper surface of said support platform and a rearward position where the operator can reach a first row of keyboard keys while the operator's palm heels, wrists and forearms remain at rest on said upper surface of said support platform whereby all keyboard keys can be operated by flexion and extension of the operator's fingers with substantially no flexion or extension of the operator's wrists which along with the operator's palm heels and forearms remain on said upper surface of said support platform; said carriage means including means for retaining said support platform in a stationary position when a selected downward force is applied to said support platform and for permitting said support platform to be moved when less than said selected downward force is applied to said support platform.

17. The support apparatus according to claim 16, wherein: said means for retaining said support platform in a stationary position and for permitting said support platform to be moved includes spring means responsive to the selected downward force to retain said support platform in a stationary position.

18. The support apparatus according to claim 16, wherein: said carriage means for supporting said support platform can move said support platform between about one inch and about four inches in said direction perpendicular to the rows of keyboard keys; and said forward edge of said support platform at least overlaps a portion of the keyboard but extends no farther than to overlap a second row of keyboard keys adjacent said first row of keyboard keys when said support platform is in its forward most position.

19. The support apparatus according to claim 18, wherein: said forward edge of said support platform is spaced from a first row of the keyboard keys at least one half of an inch when said support platform is in its rearward most position.

20. The support apparatus according to claim 18, wherein: said forward edge of said support platform is spaced from a first row of the keyboard keys at least one and one half inches when said support platform is in its rearward most position.

21. The support apparatus according to claim 16, wherein:

said carriages means has means biasing said carriage means toward said forward most position so that said support platform rests in said forward position when said support apparatus in not in use.

22. The support apparatus according to claim 16, including:

a base member for supporting said carriage means and for supporting a keyboard relative to said support apparatus and for adjusting the spacing between said first and second planes.

23. The support apparatus according to claim 16 wherein: said carriage means includes means for moving said support platform in a second direction parallel to the keyboard rows.

24. A support apparatus for supporting the palm heels, wrists and forearms of an operator to minimize flexion and extension of the operator's wrists when operating keyboards, comprising:

first and second support platforms for supporting the palm heels, wrists and forearms of an operator relative to a keyboard; said support platforms having forward edges and rear edges and upper surfaces upon which the operator's palm heels, wrists and forearms rest while operating the keyboard keys; said upper surfaces of said support platforms lying in a first plane substantially parallel to and adjacent a second plane containing upper surfaces of keys of the keyboard so that the operator can operate the keyboard keys by flexion and extension of the fingers with substantially no flexion or extension of operator's wrists which along with the operator's palm heels and forearms remain essentially at rest on said upper surfaces of said support platforms while the keyboard is being operated; at least one of said support platforms comprises pivot means adjacent its forward edge for permitting the palm heel and hand of the operator to pivot relative to the wrist while being supported by said pivot means; and carriage means for supporting said first and second support platforms independently of each other so that said first and second support platforms can be moved in said first plane in a first direction perpendicular to the keyboard rows between forward most positions where the operator can reach a last row of keyboard keys while the operator's palm heels, wrists and forearms remain at rest on said upper surfaces of said support platforms and rearward most positions where the operator can reach a first row of keyboard keys while the operator's palm heels, wrists and forearms remain at rest on said upper surfaces of said support platforms and in a second direction parallel to the keyboard rows whereby all keyboard keys can be operated by flexion and extension of the operator's fingers with substantially no flexion or extension of the operator's wrists which along with the operator's palm heels and forearms remain at rest on said upper surfaces of said support platforms.

25. The support apparatus according to claim 24, wherein: both of said support platforms comprise a pivot means.

26. The support apparatus according to claim 24, wherein: said pivot means is a disk rotatably mounted on said at least one of said support platforms to rotate about an axis perpendicular to said first plane.

27. The support apparatus according to claim 26, wherein: said pivot means is detachably mounted on said at least one of said support platforms.

28. The support apparatus according to claim 26, wherein: both of said support platforms comprise a pivot means.

29. The support apparatus according to claim 24, wherein: said pivot means is a forward portion of said at least one of said support platforms that is pivotally mounted to said at least one of said support platforms to pivot about an axis perpendicular to said first plane.

30. The support apparatus according to claim 29, wherein: both of said support platforms comprise a pivot means.

31. A support apparatus for supporting the palm heels, wrists and forearms of an operator to minimize flexion and extension of the operator's wrists when operating keyboards, comprising:

first and second support platforms for supporting the palm heels, wrists and forearms of an operator relative to a keyboard; said support platforms having forward edges and rear edges and upper surfaces upon which the operator's palm heels, wrists and forearms rest while operating the keyboard keys; said upper surfaces of said support platforms lying in a first plane substantially parallel to and adjacent a second plane containing upper surfaces of keys of the keyboard so that the operator can operate the keyboard keys by flexion and extension of the fingers with substantially no flexion or extension of operator's wrists which along with the operator's palm heels and forearms remain essentially at rest on said upper surfaces of said support platforms while the keyboard is being operated; at least one of said support platforms comprises a forward portion comprising a forward most portion having a convex upper surface contoured to be received in the palm of the hand; a narrowed waist portion having an upper surface contoured to be received under the palm heel of the hand; and rearward portion wider than said narrowed waist portion and having an upper surface contoured to be received under the wrist of the operator; and carriage means for supporting said first and second support platforms independently of each other so that said first and second support platforms can be moved in said first plane in a first direction perpendicular to the keyboard rows between forward most positions where the operator can reach a last row of keyboard keys while the operator's palm heels, wrists and forearms remain at rest on said upper surfaces of said support platforms and rearward most positions where the operator can reach a first row of keyboard keys while the operator's palm heels, wrists and forearms remain at rest on said upper surfaces of said support platforms and in a second direction parallel to the keyboard rows whereby all keyboard keys can be operated by flexion and extension of the operator's fingers with substantially no flexion or extension of the operator's wrists which along with the operator's palm heels and forearms remain at rest on said upper surfaces of said support platforms.

32. The support apparatus according to claim 31, wherein: both of said support platforms comprise a forward portion.

33. A palm heel, wrist and forearm support for use with a keyboard, comprising: a support platform for supporting the palm heel, wrist and forearm of an operator relative to a keyboard; said support platform having a forward edge and a rear edge and an upper surface upon which the operator's palm heel, wrist and forearm rest while operating the keyboard keys; said support platform being adapted to supported on a carriage for movement relative to the keyboard with said upper support surface lying in a first plane substantially parallel to and adjacent a second plane containing upper surfaces of keys of the keyboard so that the operator can operate the keyboard keys by flexion and extension of the fingers with substantially no flexion or extension of operator's wrist which along with the operator's palm heel and forearm remains essentially at rest on said upper surface of said support platform while the keyboard is being operated; and said support platform including pivot means adjacent its forward edge for permitting the palm heel and hand of the operator to pivot relative to the wrist while being supported by said pivot means.

34. The support according to claim 33, wherein: said pivot means is a disk rotatably mounted on said support platform to rotate about an axis perpendicular to said first plane.

35. The support according to claim 33, wherein: said support platform has means for detachably mounting said support platform and a second support platform directly secured to said carriage.

36. The support according to claim 33, wherein: said pivot means is a forward portion of said support platform that is pivotally mounted to said support platform to pivot about an axis perpendicular to said first plane.

* * * * *